United States Patent [19]

Gileadi et al.

[11] 3,997,410

[45] Dec. 14, 1976

[54] ELECTRODEPOSITION OF ALUMINUM

[76] Inventors: Eliezer Gileadi, 9 Maale Hashoeva St., Ramat-Gan; Emanuel Peled, 4 Hashomer St., Givatayim, both of Israel

[22] Filed: Feb. 3, 1975

[21] Appl. No.: 546,785

[30] Foreign Application Priority Data

Feb. 6, 1974 Israel ..... 44151

[52] U.S. Cl. ..... 204/14 N

[51] Int. Cl.[2] ..... C25D 1/00

[58] Field of Search ..... 204/14 N, 39

[56] References Cited

UNITED STATES PATENTS

| | | | |
|---|---|---|---|
| 2,170,375 | 8/1939 | Mathers et al. | 204/14 N |
| 2,651,608 | 9/1953 | Brenner | 204/14 N |
| 3,268,421 | 8/1966 | McGraw | 204/14 N |
| 3,595,760 | 7/1971 | Ishibashi et al. | 204/14 N |
| 3,672,965 | 6/1972 | Harwood | 204/14 N |
| 3,775,260 | 11/1973 | Capuano et al. | 204/14 N |

*Primary Examiner*—T. M. Tufariello
*Attorney, Agent, or Firm*—Browdy and Neimark

[57] ABSTRACT

A novel process for the electrodeposition of aluminum on metals, metal alloys and on electrically conducting surfaces. More particularly, the invention relates to the electrodeposition of aluminum on metals such as copper, steel, magnesium, titanium, or uranium; on alloys such as bronze and on substances such as carbon, graphite, etc. The invention relates furthermore to novel solutions which serve as baths for the electrodeposition of aluminum from same. Other and further aspects of the present invention will become apparent hereinafter. According to the invention there is provided:

1. An electrolyte for the electrodeposition of aluminum comprising in combination:
   a. aluminum bromide;
   b. a solvent selected from the group consisting of toluene, and toluene in admixture with other aromatic liquid solvents of aluminum bromide, other than benzene;
   c. an additive selected from the group consisting of aromatic hydrocabons having at least two rings; alkylated monocyclic or polycyclic aromatic compounds, aminosubstituted and halosubstituted mono- or polycyclic aromatic compounds, dialkyl aniline, trialkyl amine;
   d. Bromides or iodides selected from the group consisting of alkali metal halides, alkaline earth metal halides, boron halides, ammonium halides, aliphatic and aromatic quaternary ammonium halides and mixtures of any of these.

14 Claims, No Drawings

ELECTRODEPOSITION OF ALUMINUM

DESCRIPTION OF THE PRIOR ART

Many attempts were made to electrodeposit aluminum on various metals and other substrates. Most of these were not entirely successful, and there do not exist any processes which are entirely satisfactory. Various Russian authors have dealt with this problem, but they did not attain satisfactory results. Simanavicius et. al., Lietuvos TSR Moksly akademijos darbai, B seria 1 (64)t. (1971) deal with the electrodeposition of aluminum from solutions of aluminum bromide in xylene. No satisfactory deposits could be obtained. The same author, same publication, B seria, 3(54)t (1968) deal with cathodic process studies in aluminum bromide solutions in p-xylene at small current densities. The electrochemical reaction products were found to be hydrogen and p-xylene. The same authors, same publication, B-serija, 4(63) t (1970) deal with the process taking place at aluminum electrodeposition from aluminum bromide solutions in xylene. Also in this work no satisfactory plating of aluminum was achieved. The electrodeposition of aluminum from organic electrolytes is reviewed by Bernner in J.Electrochem. Soc. 106 (1959) 148 and in Advan. Electrochem. Eng. 5 (1967) 205. None of the proposed systems has attained widespread commercial use. Capuano and Davenport describe in "Plating Aluminum onto Steel or Copper from Alkyl Benzene Electrolytes", Plating March 1973, page 251–5 and in J.Electr. Soc. Oct. 1971, 1688–95 "Electrodeposition of Aluminum from Alkyl Benzene Electrolytes", as well as in a Canadian patent and U.S. Pat. No. 3,775,260, a process for the electroplating of an electrically conductive substrate from an electrolyte comprising an aluminum halide, particularly aluminum bromide, in solution in an organic solvent consisting of certain alkyl benzene having at least two carbon atoms in the alkyl groups, alone, in admixture with each other or in admixture with other alkyl benzenes, benzene or halobenzene. The solvents are stipulated to be hydrous, and it is stated that the solutions must contain water (at least 25% of saturation), and preferably at least 33%, as otherwise no electrodeposition takes place. Water must be present to provide adequate conductivity. The highest cathodic efficiency claimed by the Canadians in their patent is 85%. Contrasted with the prior art, the current efficiencies attained in the process of the present invention are essentially 100 per cent and the chemical stability of the plating bath is substantially improved. According to the invention there are obtained well-adhering coatings; of aluminum of adequate thickness. The plating baths according to the present invention comprise advantageously at least one component chosen from each of the following groups:

a. Dry aluminum bromide of at least 97% purity, possibly in admixture with aluminum iodide, possible with some aluminum chloride or fluoride.

b. Dry toluene, possibly in admixture with minor quantities of other liquid aromatic compounds, with the exception of benzene which has a detrimental effect.

c. An aromatic compound having at least 2 aromatic rings, alkyl derivatives of monocyclic or polycyclic aromatic compounds, or amino-substituted compounds of this kind, Lewis bases of the type of dialkyl aniline, trialkyl amine and the like;

d. Halides of alkali metals, or alkaline earth metals, ammonium halides, aliphatic and aromatic quaternary ammonium halides etc. Bromides and iodides are best, small amounts of the other halides can be tolerated.

As set out above, best results are obtained with mixtures of at least one member of each of the four groups. The functions of the four components are different:

a. The aluminum bromide serves as source of the aluminum which is deposited. This applies also to the complexes thereof with aluminum iodide, possibly with some chloride or fluoride.

b. The toluene serves as main solvent for the aluminum halide.

c. The compounds of this group stabilize hydrogen ions and prevent or substantially reduce the rate of reduction of these ions and of the solvent. Hydrogen ions form addition compounds with aromatic hydrocarbons. If toluene or benzene are used as only solvents the addition compound with hydrogen is not stable and by its electrochemical reduction molecular hydrogen is liberated or the solvent is decomposed electrochemically to other compounds. In such systems small quantities of water or of hydrogen bromide prevent the electrodeposition of aluminum. The effectivity of the compounds in stabilizing hydrogen ions increases as the number of alkyl groups in a given ring increases, as these become longer and more branched and as one passes from single to multiple rings. The presence of such compounds makes possible to carry out the electrodeposition of aluminum at an efficiency of 100% even in the presence of small quantities of water and hydrogen bromide. The presence of larger quantities of water is detrimental, and the current efficiency decreases even when the above mentioned compounds are present.

d. The halides of alkali metals, of alkaline earth metals and similar salts increase the conductivity of the solutions. The conductivity of dry aluminum bromide in dry toluene or benzene is very low (of the order of $10^{-9}$MhO $cm^{-1}$). The conductivity of the solutions according to the invention is substantially stable, whereas that of solutions containing water or hydrogen bromide changes with time due to undesired side-reactions and evaporation of hydrogen bromide. The salts of this group also increase the "throwing power" of the bath, decrease dendrite formation and result in an improved appearance of the deposited aluminum.

It is pointed out that some of the compounds of group (c), such as trimethyl benzene, ethyl benzene, ethyl toluene etc., can be used instead of toluene as main solvent. Compounds of group (c) which at ordinary temperature are solids may be used in the molten state at elevated temperatures, serving as main solvent, but in a less satisfactory manner.

Thus, naphthalene or hexamethyl benzene may be used in conjunction with aluminum bromide and a suitable alkali metal halide.

From the above it is clear that advantageously at least one compound of each of the four groups is used. It is possible to use one of groups (a), (c) and (d), the one of group (c) or a mixture of compounds from this group serving also as solvent.

Coatings of 100 $\mu$ thickness and more, having a good adherence to the substate, were obtained. Coated metal parts could be machined without detriment to the aluminum coating. A copper strip coated with aluminum was bent at an angle of 90° and this was repeated till the copper broke. The coating did not peal off. The aluminum coating is smooth, homogeneous fine-grained and ductile and of white-grey color. It can be anodized. It provides excellent protection against corrosion. Steel strips coated with 15 $\mu$ aluminum were kept in the laboratory for over a year and did not show any rust.

Very good coatings were obtained at current densities of from about 1 to 30 mA/cm$^2$. The current efficiency decreases somewhat about 10 mA/cm$^2$. In the range of about 1 – 10 mA/cm$^2$ current efficiency is essentially 100% and the anodic current efficiency is also about 100% at these values. Current efficiency decreases to about 80–50% at higher current densities.

In the following per cent indicates per cent by weight. With baths having toluene as main solvent concentrations of aluminum bromide of about 25–50% gave good results. The aromatic compounds of group (c) were used at concentrations of about 1 to 50%. As the concentration of this constituent is increased, the bath may contain higher quantities of water and of hydrogen bromide without detriment. The salts of group (d) are used at about 1% or even less (at least about solubility 0.3% by weight) and up to the maximum solublity of the salts in the system. Larger quantities of salt increase in enhanced quality of the coating and in an improvement of the throwing power of the bath.

Several plating baths were operated at prolonged periods of time with replenishment of/the constituents. Some were operated for 4 months (continuously), and 500 Ah/liter were passed without any perceivable decline in the quality of the coatings or of current perceivable decline in the quality of the coating or of current efficiencies.

Water contents of up to about 0.5% do not impair the quality of the coatings. Hydrogen bromide can be removed by bubbling through the bath an inert gas, such as nitrogen. The bath proper is not sensitive to oxygen, but plating can be effected only with a bath which contains practically no oxygen. Nitrogen is advantageously bubbled through the bath before the plating is commenced, and this is continued during the plating process.

EXAMPLE I (Not Part of the Invention)

A solution was made up of 40% $AlBr_3$, 30% toluene, and 30% ethylbenzene. The total volume was 60 ml. Electroplating was conducted at 10 mA cm$^{-2}$ for one hour, a copper cathode being used. The aluminium coating on the cathode contained a lot of dendrites, particularly near the edges of the electrode. Following the mechanical removal of the dendrites the electrode was weighed. The apparent current efficiency was found to be 40%. Repeated experiments with copper cathodes gave rise to irreproducible results, in respect to current efficiency. The conductivity of the solution decreased within a few days from 1 mMhO cm$^{-1}$ to 0.1 mMhO cm$^{-1}$.

EXAMPLE 2

The solution was the same as in Example 1, except that 4 g of dry potassium bromide was added. Electrodeposition on copper cathodes was conducted at a current density of 10 mA cm$^{-2}$ for one hour, as above. The current efficiency for plating was about 90%. The tendency to form dendrites was much less. Only a few dendrites were formed at the edges. The aluminum coating obtained was greyish white, smooth and ductile, and could be conveniently machined. Adhesion to the copper was excellent. Bending the copper strip at 90° back and forth caused breakage of the strip without peeling off the aluminium coating. The conductivity of the solvent remained constant, the current efficiency varied by less than 10%. The same bath was used to plate samples at current densities ranging from 1 to 30 mA cm$^{-2}$. The current efficiency was in the range of 90–100%, at current densities of 1 to 10 mA cm$^{-2}$ and decreased somewhat at higher current densities. The current efficiency for anodic dissolution of aluminium was 100% at a current density in the range of 1–10 mA cm$^{-2}$ and decreased with increasing current densities.

EXAMPLE 3

The same solution as in Example 2 was diluted by doubling the quantity of toluene. Electrodeposition was conducted on copper cathodes as above. The current efficiency for plating was similar to that of example 2. The aluminium coating was less smooth and its color a somewhat deeper grey.

EXAMPLE 4 (Not part of the invention)

The solution was made up of 50 ml. of toluene, 40 g. of $AlBr_3$ and 1 gr. of KBr. Electroplating was conducted on a copper cathode at 10 mA cm$^{-2}$ for one hour. A grey film of aluminium containing a substantial amount of organic matter was obtained. The experiment was repeated several times and similar results were obtained.

EXAMPLE 5

The solution was identical to that in Example 4 except that 4 g. naphthalene were added. Electrolysis was conducted at current densities in the range of 1 to 40 mA cm$^{-2}$. Bright, homogeneous, smooth and ductile aluminium coatings were obtained. Adherence was very good. The current efficiency was 90–100% at current densities of 1–10 mA cm and decreased with increasing current density. The current efficiency from the anodic solution was 100% for current densities of 1–10 mA cm and decreased with increasing current densities.

EXAMPLE 6

The solution was made up of 40 g. of $AlBr_3$, 60 ml. toluene, 6.2 g. anthracene and 5.1 g. lithium bromide. The quality of the aluminium coatings obtained in this bath was similar to that obtained in this bath was similar to that obtained in Examples 2 and 5.

EXAMPLE 7 (Not part of the invention)

The solution was made up of 35 g. of $AlBr_3$, 50 ml toluene and 5 g lithium bromide. Electrolysis at a current density of 10 ma cm$^{-2}$ was conducted with copper cathodes, and aluminium anodes. Poor deposits were obtained and the current efficiency was low.

EXAMPLE 8

4 ml ter-butylbenzene was added to the solution of Example 7 and electrolysis was conducted on copper cathodes at the same current density for one to two hours. The current efficiency was 90–100% and good coatings were obtained, comparable to those of Examples 2, 5 and 6.

EXAMPLE 9 (Not part of the invention)

The solution was made up of 33 g. $AlBr_3$, 55 ml. toluene and 1 g. potassium bromide. Electroplating was conducted at a current density of 10 mA $cm^{-2}$ with a copper cathode and aluminium anode. Grey to dark aluminium deposits were obtained. The current efficiency of the coating was less than 50%.

EXAMPLE 10

When 5 ml. dimethylaniline was added to the solution of Example 9, the current efficiency was increased to 80–90% and good electrodeposits, of a quality comparable to that of examples 2, 5 and 6 were obtained.

EXAMPLE 11

The solution was identical to that of Example 10 except that 1 ml. pyridine was added instead of dimethylaniline. Good deposits were obtained.

EXAMPLE 12

The solution of Example 5 was used and 0.1 ml water was added. The current efficiency decreased. When the water content was increased to 0.3 ml. deposited aluminium turned from smooth white to grey and matt and finally to brittle black. Upon addition of 0.9 ml. water a black tarlike deposit was obtained which contained only a few granules of metallic aluminium. The addition of further 1 ml. of water caused separation of the solution into two phases and prevented further electrodeposition of aluminium.

EXAMPLE 13

The solution of Example 2 was used. Electrolysis was conducted with copper cathodes and aluminum anodes. Good deposits were obtained with current efficiencies above 90% at a cathodic current density of 10 Am $cm^{-2}$. When oxygen was bubbled through the cell instead of nitrogen, the voltage between the copper cathode and the aluminium reference electrode rose quickly from 3 volts to 15 volts and above, due probably to the formation of a non-conducting layer on the cathode. After electrolysis for one hour under these conditions, the cathode was coated with a black tar which did not contain metallic aluminium. When oxygen was removed from this solution by bubbling through nitrogen for a sufficient length of time, further experiments yielded good aluminium coatings.

EXAMPLE 14

The solution of Example 2 was used and electrodeposition was conducted at 10 mA $cm^{-2}$ on clean iron cathode. A smooth, homogeneous, bright greyish-white coating of aluminium was obtained. The samples were stored for over a year in the laboratory. Examination after this period showed no stains or rust on the aluminium coating. Heavy corrosion occured on parts of the sample which were not coated.

EXAMPLE 15 (Not part of the invention)

A solution was made of 50 ml. benzene, 30g$AlBr_3$ and 1 g. KBr. Electrolysis was conducted at a current density of 10 mA $cm^{-2}$, employing copper cathodes and aluminium anodes. Black tarlike deposits were obtained.

EXAMPLE 16

Electrodeposition of aluminium was conducted in a rigorously dry system. For this purpose, a solution containing 0.5 g. KBr, 10 g. $AlBr_3$ and 30 ml. of mesitylene was prepared in a vacuum system. All three components of the solution were dried or distilled by standard vacuum techniques. The conductivity of the solution was 25 $\mu$ Mho $cm^{-1}$ and its color was light yellow. Electrolysis was conducted without removing the solution from the vacuum system, employing an aluminium anode and a copper cathode. A total current of 5 MA was passed at a current density of 1mA $cm^{-2}$ and electrolysis was conducted for one hour. The color of the cathode changed to greyish while as a result of coating with aluminium. The edges of the electrode showed heavy dendrite formation. After the removal of the cathode from the solution, a light grey aluminium coating was found on it.

CHEMICAL STABILITY OF THE PLATING BATH

The chemical stability of the various plating baths which were not dried by bubbling through nitrogen was tested. Solutions containing an aromatic solvent and $AlBr_3$ were kept in closed containers for 5 months. An analysis of the organic solvent was then conducted with a gas chromatograph.

It was found that the organic solvent had undergone exchange reactions in all samples. Alkyl groups were found to have moved from one aromatic ring to the other, giving rise to new alkyl derivatives or isomers of the initial compounds. The results of the analysis showed that:

a. In solutions containing toluene as the solvent, about 30% of this material disappeared and the main products formed were benzene xylene and mesitylene.

b. In solutions containing mesitylene as the solvent, about 25% of this compound had reacted, giving rise mainly to xylene and durene.

c. In solutions containing ethylbenzene as the solvent, nearly 70% of this compound had reacted, yielding a mixture of benzene, diethylbenzene and triethylbenzene. Thus, in the presence of moisture the plating baths are not chemically stable. This may also be due to the formation of hydrogen bromide.

ELECTROCHEMICAL STABILITY OF DRIED PLATING BATH

The electrochemical stability of solutions of the following compositions was tested. The solutions were maintained anhydrous by continuously bubbling dry nitrogen through them.

a. Mesitylene, toluene, $AlBr_3$, KBr.

b. As above, but with added potassium iodide. Deposition of aluminium on copper was conducted for 2 months under an atmosphere of dry nitrogen at a current density of 1–10mA $cm^{-2}$, the bath being replenished as required. The total charge passed through the solution was 250 Ah Lit $^{-1}$. The solutions were analysed after the end of 2 months by gas chromatography. It was found that only about 10% of the organic solvent had undergone reaction. Thus, the composition of the plating bath was not significantly changed. The derivatives of benzene found in quantities larger than 0.1% were: Bromotoluene: 0.5%, and bimesityl 5%. All other derivatives of benzene up to a boiling point of 350° C were at concentrations of less than 0.1%.

ADDITIONAL EXAMPLES

Experiments were performed and the aluminium was plated on samples of steel, copper, magnesium, titanium, bronze and graphite, from solutions described in Examples 2, 3 and 6. In all cases, bright deposits were obtained. Adhesion to magnesium, titanium and graphite was less satisfactory than to copper. In further experiments aluminium was electrodeposited from solutions containing in addition to $AlBr_3$ also small amounts of $AlI_3$ or of $AlCl_3$. satisfactory results were obtained.

Organic additives of group 3, the presence of which were found to improved the quality of the plating, were:

Ethylbenzene, Ethyl toluene, diethylxylene, mesitylene, 4 methyl, 5 methyl, and 6 methylbenzene; ter-butylbenzene, ter-butyltoluene, diter-butyl benzene, naphthalene, methyl and dimethyl naphthalene; anthracene; diphenylene, methylanthracene, methyldiphenylene; dimethylaniline, pyridine, biphenyl, diethylbenzene, bismesetyl, hexamethyltetraamine.

Halides of group 4 were tested for the purpose of increasing the electrical conductivity and the throwing power. Good results were obtained with salts of Li, K, Na, Cs with Br, and I, $MgBr_2$; ammonium salts of Br and I, tetraethyl ammonium bromide, tetraethylammonium iodide and pyridinium bromide. Minor quantities of corresponding chlorides or fluorides can be tolerated.

What is claimed is:

1. An electrolyte for the electrodeposition of aluminum consisting essentially of:

a. 10 to 50 wt% aluminum bromide b. a substantially anhydrous organic solvent selected from the group consisting of toluene, and toluene in admixture with other aromatic liquid solvents for aluminum bromide, other than benzene;

c. an additive selected from the group consisting of aromatic hydrocarbons having at least two rings; alkylated monocyclic or polycyclic aromatic compounds, aminosubstituted mono- or polycyclic aromatic compounds, dialkyl aniline, and trialkyl amine;

wherein solvent (b) and additive (c), the latter of which may also serve as solvent, constitute about 50 to 89.7 wt.% of said electrolytes;

d. bromides or iodides selected from the group consisting of alkali metal halides, alkaline earth metal halides, boron halides, ammonium halides, aliphatic and aromatic quaternary ammonium halides and mixtures of any of these, comprising from 0.3 wt.% up to concentration of saturation in said electrolyte.

2. An electrolyte as claimed in claim 1, containing in addition to aluminum bromide some aluminum iodide.

3. An electrolyte for the deposition of aluminum containing of compound of each of groups (a), (c) and (d), defined in claim 1, the compound(s) of group (c) serving also as solvent of the aluminum bromide.

4. An electrolyte as claimed in claim 1, comprising 20 to 40 weight per cent of aluminum bromide.

5. An electrolyte as claimed in claim 1, containing from 5 to 30 percent by weight of a compound or a mixture of compounds of group (c).

6. An electrolyte as claimed in claim 1, containing from 2.0 per cent by weight and up to saturation concentration of a bromide or iodide of group (d).

7. An electrolyte as claimed in claim 1, containing up to about 0.5 per cent of water.

8. A process for the electrodeposition of aluminum on electrically conducting substrates, which comprises electroplating the substrate in a plating bath as claimed in claim 1, an inert gas being bubbled through the plating bath during the process of electrodeposition.

9. A process as claimed in claim 8, wherein the inert gas is dry nitrogen or argon.

10. A process as claimed in claim 8, wherein the bath contains as solvent one or more compounds of group (c) defined in claim 1.

11. A process as claimed in claim 8, wherein the content of water is less than 0.5 per cent and wherein the hydrogen bromide which is formed during the plating process is removed by the stream of inert gas.

12. An essentially anhydrous electrolyte for the electrodeposition of aluminum, consisting essentially of:

10 to 50 wt.% of dry aluminum bromide of at least 97% purity;

a substantially anhydrous organic solvent selected from the group consisting of (1) toluene, (2) toluene in admixture with another aromatic liquid solvent for aluminum bromide, other than benzene, and (3) a solvent for aluminum bromide other than benzene selected from the group consisting of aromatic hydrocarbons having at least 2 rings, alkylated monocyclic or polycyclic aromatic compounds, aminosubstituted mono- or polycyclic aromatic compounds, dialkyl aniline, or trialkyl amine; said solvent being present in an amount sufficient to dissolve said aluminum bromide;

when said substantially anhydrous organic solvent is toluene or toluene in admixture with another aromatic liquid solvent other than benzene, said electrolyte further comprising an additive selected from the group consisting of aromatic hydrocarbons having at least 2 rings, alkylated monocyclic or polycyclic aromatic compounds, aminosubstituted mono- or polycyclic aromatic compounds, dialkyl aniline and trialkyl amines; said additive being present in an amount sufficient to stabilize hydrogen ions in said electrolyte and prevent or substantially reduce the rate of reduction of said hydrogen ions and of said solvent; and bromides or iodides selected from the group consisting of alkali metal halides, alkaline earth metal halides, boron halides, ammonium halides, aliphatic and aromatic quaternary ammonium halides and mixtures thereof; said bromides or iodides being present in an amount sufficient to increase the conductivity of said aluminum bromide in said electrolyte and to increase the throwing power of said electrolyte and to decrease dendrite formation;

said electrolyte being substantially free of benzene, oxygen, hydrogen bromide and water, with the quantity of water not exceeding 0.5% by weight.

13. An electrolyte in accordance with claim 12 wherein said solvent comprises toluene; wherein said aluminum bromide is present in a quantity of 25–50% by weight; wherein said additive is present in a concentration of about 1 to 50% by weight and is selected from the group consisting of ethyl benzene, ethyl toluene, diethylzylene, mesitylene, 4-methyl benzene, 5-methyl benzene, 6-methyl benzene, ter-butyl benzene, ter-butyl toluene, diter-butyl benzene, naphthylene, methyl naphthylene, dimethyl naphthylene, anthracene, diphenylene, methyl anthracene, methyl diphenylene, dimethyl analine, pyridine, biphenyl, diethyl benzene, dismesetyl and hexamethyl teteraamine.

14. An electrically conductive substrate having a tightly adhering smooth, homogeneous fine-grained and ductile coating of aluminum having a thickness of about 15 microns to about 100 microns, obtained by the process of claim 8.

* * * * *